US007345435B1

(12) United States Patent
Sekutowicz et al.

(10) Patent No.: US 7,345,435 B1
(45) Date of Patent: Mar. 18, 2008

(54) SUPERSTRUCTURE FOR HIGH CURRENT APPLICATIONS IN SUPERCONDUCTING LINEAR ACCELERATORS

(75) Inventors: Jacek Sekutowicz, Elbchaussee (DE); Peter Kneisel, Williamsburg, VA (US)

(73) Assignee: Jefferson Science Associates LLC, Newport News, VA (US)

( * ) Notice: Subject to any disclaimer, the term of this patent is extended or adjusted under 35 U.S.C. 154(b) by 683 days.

(21) Appl. No.: 11/010,905

(22) Filed: Dec. 13, 2004

(51) Int. Cl.
*H01J 23/00* (2006.01)
*H05H 9/00* (2006.01)

(52) U.S. Cl. ..... 315/500; 315/505

(58) Field of Classification Search ..... 315/39, 315/41, 42–43, 500, 501, 502, 503, 505, 315/506, 507
See application file for complete search history.

(56) References Cited

U.S. PATENT DOCUMENTS 4,629,938 A * 12/1986 Whitham ..... 315/5.41
4,988,919 A * 1/1991 Tanabe et al. ..... 315/5.41
6,366,641 B1 * 4/2002 Whitham ..... 378/65
6,376,990 B1 * 4/2002 Allen et al. ..... 315/5.41
6,407,505 B1 * 6/2002 Bertsche ..... 315/5.41
6,642,678 B1 * 11/2003 Allen et al. ..... 315/505
6,646,383 B2 * 11/2003 Bertsche et al. ..... 315/5.41

* cited by examiner

*Primary Examiner*—Douglas W. Owens
*Assistant Examiner*—Dieu A Minh

(57) ABSTRACT

A superstructure for accelerating charged particles at relativistic speeds. The superstructure consists of two weakly coupled multi-cell subunits equipped with HOM couplers. A beam pipe connects the subunits and an HOM damper is included at the entrance and the exit of each of the subunits. A coupling device feeds rf power into the subunits. The subunits are constructed of niobium and maintained at cryogenic temperatures. The length of the beam pipe between the subunits is selected to provide synchronism between particles and rf fields in both subunits.

16 Claims, 2 Drawing Sheets

SUPERSTRUCTURE FOR HIGH CURRENT APPLICATIONS IN SUPERCONDUCTING LINEAR ACCELERATORS

The United States of America may have certain rights to this invention under Management and Operating contract No. DE-AC05-84ER40150 from the Department of Energy.

FIELD OF THE INVENTION

This invention relates to linear accelerators and specifically to an improved accelerating structure for accelerating a high current beam of charged particles.

BACKGROUND OF THE INVENTION

High power Free Electron Lasers (FEL) with power levels of 10 kW of infrared laser light have recently been demonstrated at the Thomas Jefferson National Accelerator Facility (TJNAF) in Newport News, Va. Although 10 kW of laser light is a substantial achievement, even higher levels of power would support advanced studies of biology, chemistry, and physics and enhance manufacturing technologies.

A linear accelerator (linac) supplies the FEL with electrons at relativistic speeds. For higher levels of FEL power, such as 1 MW, improvements are required in the accelerating structures in the linac. To achieve a power level of 1 MW in the FEL, electron beams in the range of 500 to 1,000 mA have to be accelerated in the linac supplying the FEL.

Successful operation of a linac at 0.5 to 1 amperes of current will require the accelerators to be based on superconducting technology. Additionally, Higher Order Modes (HOM) excited by the beams must be effectively damped to allow stable operation of the linac.

Therefore, one of the requirements for increasing the power level of an FEL to the 1 MW range is an accelerating structure capable of accelerating an electron beam in the linac to the level of 0.5 to 1 ampere and having sufficient damping to suppress the HOMs excited by the beams.

SUMMARY OF THE INVENTION

The invention is a superstructure for accelerating charged particles at relativistic speeds. The superstructure is made of two weakly coupled multi-cell subunits and equipped with HOM couplers. A beam pipe connects the subunits and an HOM damper is included at the entrance and the exit of each of the subunits. A coupling device feeds rf (radio frequency) power into the subunits. The subunits are constructed of niobium and maintained at cryogenic temperatures. The length of the beam pipe between the subunits is selected to provide synchronism between particles and rf fields in both subunits.

OBJECTS AND ADVANTAGES

The superstructure beam of the present invention enables acceleration of electrons to achieve an electron beam at 0.5 to 1 A. Use of a superstructure over conventional accelerating structures advantageously increases the active cavity length as a percentage of the total length of the linac and also significantly reduces the amount of microwave components. The superstructure of the present invention reduces the number of cells per structure and therefore reduces the amount of trapped HOMs. The reduction in number of cells and microwave components leads to a significant reduction in the cost of the accelerating structures. The superstructure is very compact and will provide excellent HOM damping. The compactness of the superstructure and the reduction in the number of power feeds for the subunits reduces the number of required rf components and therefore significantly improves the economics of the linac.

TABLE OF NOMENCLATURE

Figure 1:
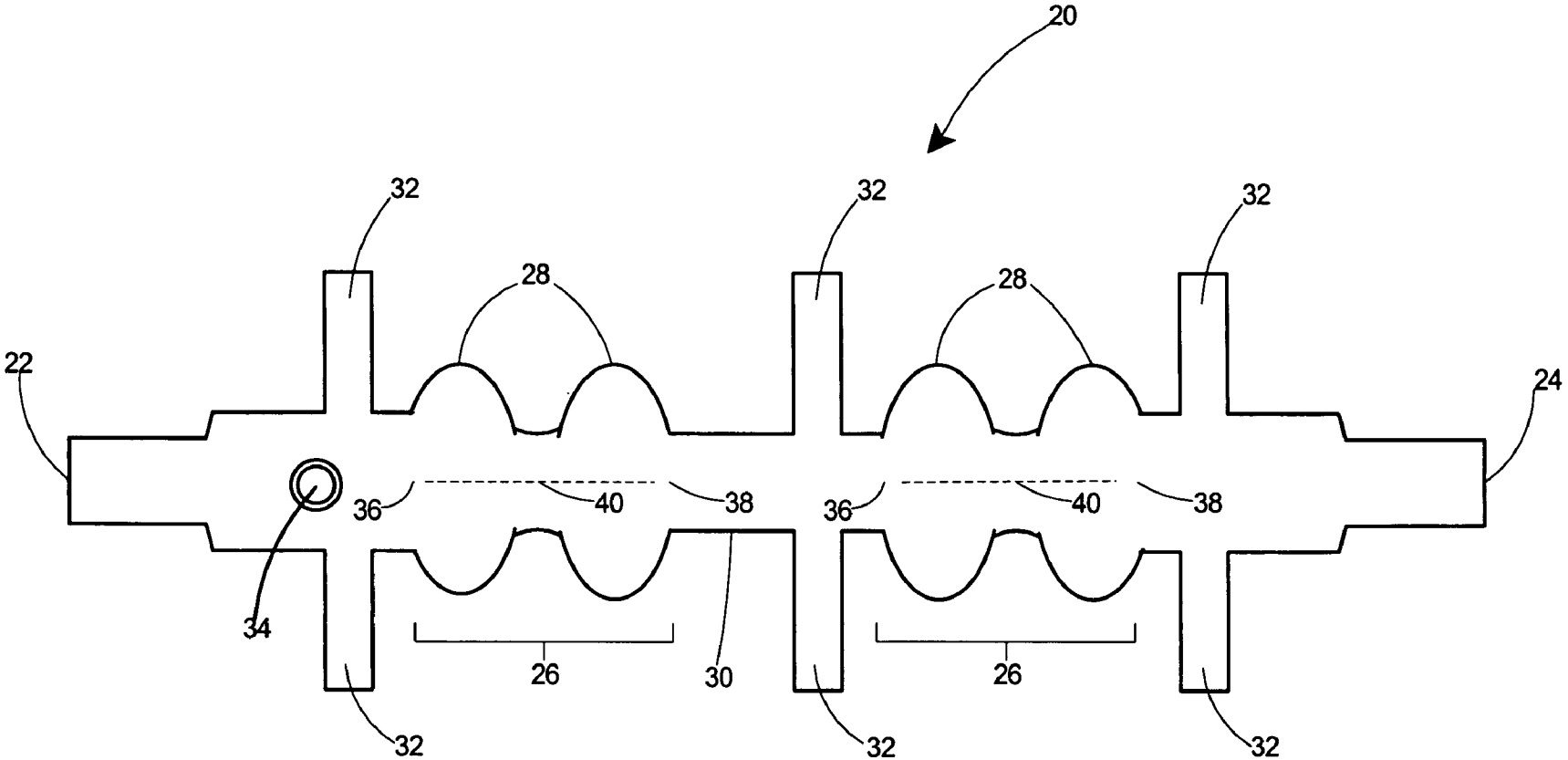
FIG. 1 is a conceptual side view of a preferred embodiment of a superstructure according to the present invention including 6 HOM couplers and a coaxial input coupler.

The following is a listing of part numbers used in the drawings along with a brief description:

| Part Number | Description |
|---|---|
| 20 | superstructure |
| 22 | input end |
| 24 | output end |
| 26 | subunit |
| 28 | cell or cavity |
| 30 | beam pipe |
| 32 | HOM coupler |
| 34 | power coupler |
| 36 | entrance opening to subunit |
| 38 | exit opening from subunit |
| 40 | beam line |
| 42 | equator |
| 44 | iris |
| $D_E$ | equator diameter |
| $D_I$ | iris diameter |
| $D_B$ | beam tube diameter |
| $D_A$ | beam tube diameter after taper |
| $L_C$ | cell length |
| $L_B$ | length of the interconnecting beam pipe |

DETAILED DESCRIPTION OF THE INVENTION

With reference to FIG. 1, the present invention is a superstructure 20 for acceleration of electrons in a high-energy electron beam. The superstructure 20 has an input end 22 and an output end 24. The superstructure 20 includes two subunits 26 having two cells 28 or cavities each resonating at 750 MHz and connected by a larger diameter beam pipe 30. The beam pipe 30 provides approximately 0.024% coupling between the subunits 26. Two coaxial type HOM couplers 32 of approximately 70 mm diameter are located on each end 22, 24 of the superstructure 20 and on the interconnecting beam pipe 30. A power coupler 34 of the coaxial variety is located on the input end 22. Each subunit includes an entrance opening 36, an exit opening 38, and a beam line 40 therebetween.

Figure 2:
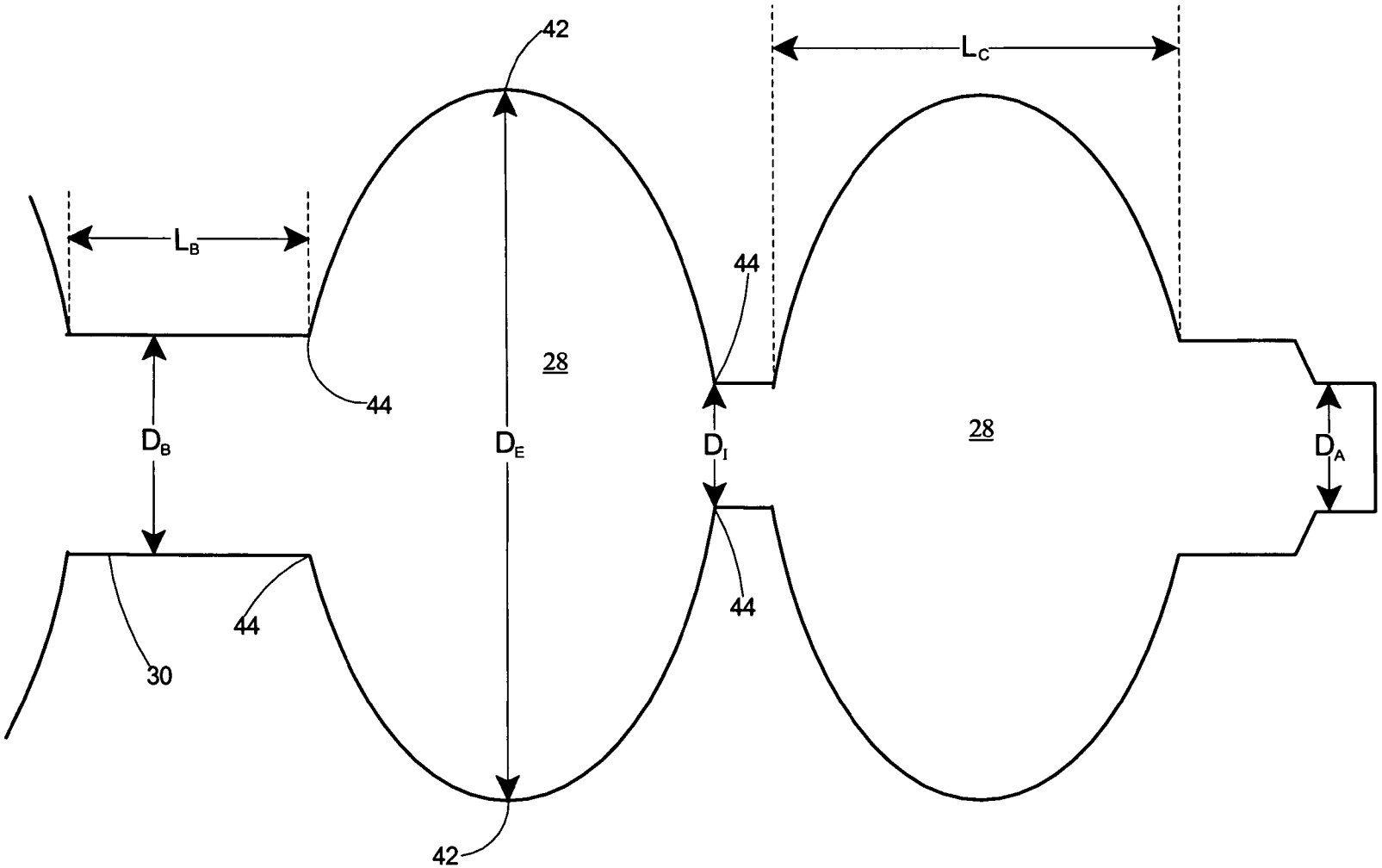
FIG. 2 is a conceptual side view of a portion of the right side of the superstructure shown in FIG. 1.

Referring to FIG. 2, the cells 28 include an equator 42 at the farthest lateral extent of the cells 28 and an iris 44 at each junction with the beam pipe 30. The geometry of the superstructure 20, or critical dimensions as shown in FIG. 2, includes the equator diameter $D_E$, the center iris diameter $D_I$, the beam tube diameter $D_B$, the beam tube diameter after taper $D_A$, the cell length $L_C$, and the length of the interconnecting beam pipe $L_B$. The geometry of the superstructure 20 is listed in Table 1.

TABLE 1

| Cavity Cell Geometry. | |
|---|---|
| Equator Diameter [mm] | 362.6 |
| Center Iris Diameter [mm] | 130 |
| Beam Tube Diameter [mm] | 180 |
| Beam Tube Diameter after Taper [mm] | 120 |
| Cell length [mm] | 200 |
| Length of Interconnecting Beam Pipe [mm] | 200 |
| HOM Coupler Body Diameter [mm] | 70 |

The RF properties are summarized in Table 2.

TABLE 2

| RF properties of 2-cell on 2-subunit superstructure. | |
|---|---|
| Frequency [MHz] | 749.552 |
| Geometry Factor [Ω] | 280 |
| (R/Q)/L [Ω/m] | 443 |
| (R/Q)/cell [Ω] | 88.6 |
| $E_{peak}/E_{acc}$ | 2.2 |
| $H_{peak}/E_{acc}$ [mT/(MV/m)] | 4.74 |
| Coupling between subunits [%] | 0.024 |

The superstructure design features a rather large beam hole for good coupling of HOMs. The large beam hole compromises the R/Q to some extent, but still results in a reasonable ratio of $E_{peak}/E_{acc}$. With the R/Q value of ~89 Ω/cell, the power dissipated in the superstructure at a Q-value of $8.10^9$ is approximately 68 W.

Table 3 lists the first 20 monopole modes. Mode No. 14 ($TM_{020}$) is the mode with the highest impedance of 36.5Ω, which is however a factor of 10 smaller than the fundamental mode (R/Q) value (mode No. 3). The field distribution of the mode No. 14 shows sufficient field strength at the locations of the HOM couplers thereby indicating appropriate damping. The total impedance for the first 16 monopole modes is approximately 140Ω. None of the first 16 modes falls on a machine line (N*1500 MHz).

TABLE 3

First 20 monopole modes for the 2-cell on 2-subunit superstructure.

| MODE# | FREQUENCY [MHz] | R/Q [Ω] |
|---|---|---|
| 1 | 741.713 | 0.0001 |
| 2 | 741.880 | 1.467 |
| 3 | 749.552 | 354.5 |
| 4 | 749.732 | 0.005 |
| 5 | 1308.134 | 3.806 |
| 6 | 1315.955 | 0.072 |
| 7 | 1316.844 | 20.017 |
| 8 | 1360.734 | 8.713 |
| 9 | 1400.082 | 0.173 |
| 10 | 1402.311 | 13.759 |
| 11 | 1446.805 | 4.788 |
| 12 | 1506.112 | 0.268 |
| 13 | 1522.499 | 0.676 |
| 14 | 1543.080 | 36.534 |
| 15 | 1575.144 | 8.049 |
| 16 | 1646.739 | 9.335 |
| 17 | 1647.143 | 6.728 |
| 18 | 1724.096 | 4.946 |
| 19 | 1898.317 | 0.712 |
| 20 | 1900.470 | 19.676 |

The dipole modes up to a frequency of 1950 MHz have been calculated with MAFIA and are listed in Table 4 below. MAFIA, an acronym for Maxwell's Equations by the Finite Integration Algorithm, is a computer program for solving problems in the simulation of electromagnetic fields. As shown in Table 4, the shunt impedances (R/Q) are favorably small.

TABLE 4

Dipole Modes.

| Mode | F [GHz] | Q | R/Q [Ω/cm$^2$] |
|---|---|---|---|
| 1 | 0.854 | 33890 | 0.095 |
| 2 | 0.863 | 35348 | 0.147 |
| 3 | 0.889 | 37449 | 0.226 |
| 4 | 0.904 | 41297 | 0.432 |
| 5 | 0.989 | 31390 | 2.817 |
| 6 | 1.000 | 32790 | 0.003 |
| 7 | 1.072 | 47165 | 0.097 |
| 8 | 1.074 | 46766 | 0.550 |
| 9 | 1.124 | 40478 | 0.020 |
| 10 | 1.124 | 40475 | 0.165 |
| 11 | 1.137 | 47585 | 0.421 |
| 12 | 1.302 | 59513 | 0.024 |
| 13 | 1.330 | 50714 | 0.001 |
| 14 | 1.340 | 50509 | 0.157 |
| 15 | 1.413 | 51084 | 0.261 |
| 16 | 1.435 | 46926 | 0.281 |
| 17 | 1.534 | 55815 | 0.752 |
| 18 | 1.565 | 42610 | 0.521 |
| 19 | 1.565 | 42497 | 0.007 |
| 20 | 1.640 | 46049 | 0.028 |
| 21 | 1.645 | 49704 | 0.017 |
| 22 | 1.706 | 61608 | 0.792 |
| 23 | 1.720 | 65542 | 0.003 |
| 24 | 1.749 | 103346 | 0.054 |
| 25 | 1.764 | 89708 | 0.008 |
| 26 | 1.775 | 58759 | 0.082 |
| 27 | 1.814 | 86002 | 0.074 |
| 28 | 1.906 | 59827 | 0.011 |
| 29 | 1.921 | 58991 | 0.125 |
| 30 | 1.939 | 79307 | 0.054 |

The choice of the frequency of 750 MHz as opposed to 500 MHz was dictated by the following considerations:

a). Under the assumption that the beam alignment will be the same for a 1 A beam as it is for a 100 mA beam, which was the threshold current for the 1500 MHz superstructure and the achieved damping results for dipole modes, the threshold current at this frequency would be 2× higher, since the impedance (R/Q) scales with $1/r^2$ where r=iris diameter, which scales with frequency. The threshold current is proportional to 1/v(R/Q). A threshold current of 1 A is therefore achievable with a reduction of the number of cells from 5 to 2 and an appropriate opening of the iris diameter.

b). The second consideration for proposing a 750 MHz cavity is the existing infrastructure for cavity treatments. Both the cabinets for chemical polishing and high pressure rinsing are size limited to a cavity length of ~130 cm. The 750 MHz superstructure as shown in FIG. 1 has an active length of 4×20 cm plus 20 cm for the interconnecting beam pipe and 15 cm on each side of the structure for beam pipes. These either must be tapered down to a smaller diameter beyond the HOM couplers to increase the damping of the fundamental mode or the beam pipes must be extended with bolted on extensions.

The superstructure will be fabricated of niobium. The niobium cavities will be operated at cryogenic temperatures, or a temperature below 4.2 K, so that they are superconducting.

Table 5 includes a detailed list of proposed assumptions and parameters for a 1 MW FEL based on the superstructure disclosed herein.

TABLE 5

Assumptions and parameters for a 1 MW FEL superstructure.

| | Units | Value |
|---|---|---|
| LINAC: | | |
| Assumptions: | | |
| Energy gain in linac | MeV | 145 |
| Real Estate Gradient | MV/m | 8.7 |
| F | MHz | 750 |
| Operating Temperature | K | <4.2 |
| Operation Mode | — | cw |
| Fill factor | — | 0.5 |
| Energy Recovery Efficiency | % | 99 |
| Resulting Parameters | | |
| Length of the linac | M | 16.7 |
| Active length | M | 8.3 |
| Gradient in cavities | MV/m | 17.4 |
| BEAMS: | | |
| Assumptions: | | |
| $I_{beam}$/beam | A | 1 |
| Bunch frequency: acceleration | MHz | 750 |
| Bunch frequency: deceleration | MHz | 750 |
| 2 x beams current | A | 2 |
| Resulting Parameters | | |
| Charge/bunch | C | 1.3E−09 |
| CAVITIES: | | |
| Assumptions: | | |
| F | MHz | 750 |
| $Q_0$ | — | 8.0E+09 |
| Number of cells/unit | — | 4 |
| (R/Q) | Ω | 354 |
| Lcav active | M | 0.8 |
| Number of cavities | — | 10 |
| Number of cavities per cryomodule | — | 5 |
| Number of HOM couplers | — | 6 |
| Resulting Parameters | | |
| Voltage/cavity | MV | 13.92 |
| Cryo-Loss/cavity | W | 6.84E+01 |
| Power/cavity with energy recovery | W | 139200 |
| Total Dynamic Cryo-Loss | W | 6.84E+02 |
| Plug in power for cryo | kW | 4.79E+02 |
| HOM (resonant mode No. 14): | | |
| (R/Q) | Ω | 36 |
| Tolerable Power/HOM Coupler | W | 300 |
| Total Tolerable HOM Power | W | 1800 |
| Qext/HOM coupler needed for the tolerable power | — | 75 |

The present invention as described herein is a superstructure for a 1 Amp beam, resonating at 750 MHz and consisting of two 2-cell subunits coupled weakly by a beam pipe. This superstructure features a total of 6 coaxial type HOM couplers. Two HOM couplers are located at the end of each subunit and two at the interconnecting beam pipe. The superstructure also includes a high power coaxial input coupler of the KIK (SNS) type, as described in "Superconducting Cavities for HERA", B. Dwersteg et al., Proceedings of the 3. Workshop on RF Superconductivity, Report ANL-PHY-88-1, p. 81ff, ANL, 1987.

Simulation calculations indicate that the ratio of peak surface fields and accelerating gradients are reasonable, whereas the shunt impedance suffers somewhat from the large iris diameter. The HOM spectrum of this structure is quite favorable as the highest parasitic shunt impedance is only 10% of the fundamental mode shunt impedance indicating that the HOMs would be damped to $Q_{ext}$ values of less than 1000. In this case the HOM power generated by the beam would be only 60 W, distributed over 6 HOM couplers.

As described herein, the present invention describes a method of developing a superstructure for accelerating charged particles in a high energy particle beam. The method for developing a superstructure includes 1) selecting a resonant frequency, 2) providing a cell including a cell length, an equator diameter, and an iris diameter, 3) connecting a plurality of the cells into a multi-cell subunit, 4) connecting the subunits with a beam tube, 5) weakly coupling the subunits, 6) providing a plurality of couplers for feeding rf power into the subunits to define a superstructure, 7) identifying the monopole modes for the superstructure, 8) adjusting the field strength of each monopole mode to achieve appropriate damping, 9) determining the dipole modes at a range of frequencies, and 10) verifying that the impedances for each dipole mode are small.

Although the specific embodiment described herein is comprised of 2-cell subunits, the superstructure for high current applications can be constructed of subunits having between one and nine cells per subunit.

Having thus described the invention with reference to a preferred embodiment, it is to be understood that the invention is not so limited by the description herein but is defined as follows by the appended claims.

What is claimed is:

1. A superstructure for accelerating charged particles in a high energy particle beam comprising:

two coupled multi-cell accelerating subunits;

said subunits including an entrance opening, an exit opening, and a beam line therebetween;

a beam pipe connecting said subunits;

a higher order mode coupler at said entrance and said exit of each of said subunits;

a power coupling device for feeding rf power into said subunits;

said subunits and beam pipe maintained at cryogenic temperature; and said beam pipe between said subunits of a length selected to provide synchronism between particles and rf fields in both subunits.

2. The super-structure of claim 1 wherein each of said multi-cell subunits include between one and nine cells.

3. The super-structure of claim 1 including a first and a second subunit;

two of said higher order mode couplers at said entrance opening of said first subunit;

two of said higher order mode couplers at said exit opening of said second subunit; and two of said higher order mode couplers at said beam pipe.

4. The super-structure of claim 1 wherein said subunits and said beam pipe are maintained at a temperature below 4.2 K.

5. The super-structure of claim 4 wherein said length of said beam pipe between said subunits is equal to one-half of the wavelength.

6. The super-structure of claim 2 wherein said cells include an equator having a diameter;

a center iris having a diameter; and a cell length.

7. The super-structure of claim 1 wherein said higher order mode coupler is of the coaxial type.

8. The super-structure of claim 1 wherein said power coupling device is of the coaxial type.

9. The super-structure of claim 1 wherein said subunits and said beam pipe are constructed of niobium.

10. A superstructure for accelerating charged particles in a high energy particle beam comprising:

a first multi-cell accelerating subunit;

a second multi-cell accelerating subunit coupled to said first subunit;

said subunits including an entrance opening, an exit opening, and a beam line therebetween;

a beam pipe connecting said first and second subunit;

a higher order mode coupler at said entrance opening of said first subunit;

said exit opening of said second subunit; and at said beam pipe;

a power coupling device for feeding rf power into said subunits;

said subunits and beam pipe maintained at cryogenic temperature; and said beam pipe between said subunits of a length selected to provide synchronism between particles and rf fields in both subunits.

11. The super-structure of claim 10 wherein each of said multi-cell subunits include between one and nine cells.

12. The super-structure of claim 10 wherein said higher order mode coupler is of the coaxial type.

13. The super-structure of claim 10 wherein said power coupling device is of the coaxial type.

14. The super-structure of claim 10 wherein said higher order mode coupler includes two separate couplers.

15. A method for developing a superstructure for accelerating charged particles in a high energy particle beam including selecting a resonant frequency;

providing a cell including a cell length, an equator diameter, and an iris diameter;

connecting a plurality of the cells into a multi-cell subunit;

connecting the subunits with a beam tube;

coupling the subunits;

providing a plurality of couplers for feeding rf power into the subunits to define a superstructure;

identifying the monopole modes for the superstructure;

adjusting the field strength of each monopole mode to achieve appropriate damping;

determining the dipole modes at a range of frequencies, and verifying that the impedances for each dipole mode.

16. The method of claim 15 wherein said multi-cell subunit includes between one and nine cells.

* * * * *